United States Patent [19]

Boström

[11] 4,217,072

[45] Aug. 12, 1980

[54] METHOD AND APPARATUS FOR OPENING BARRELS AND FOR EMPTYING SAID BARRELS OF THEIR CONTENTS WITHOUT POLLUTING THE ENVIRONMENT

[75] Inventor: Karl-Johan Boström, Skellefteå, Sweden

[73] Assignee: Boliden Aktiebolag, Stockholm, Sweden

[21] Appl. No.: 886,113

[22] Filed: Mar. 13, 1978

[30] Foreign Application Priority Data

Mar. 21, 1977 [SE] Sweden ..... 7703213

[51] Int. Cl.[2] ..... B65B 21/02; B65G 65/34

[52] U.S. Cl. ..... 414/412; 30/433; 30/434; 414/787

[58] Field of Search ..... 214/301, 302, 305; 30/423–425, 433, 434; 414/412, 787; 222/83, 83.5; 141/330, 331

[56] References Cited

U.S. PATENT DOCUMENTS

| | | | |
|---|---|---|---|
| 2,886,887 | 5/1959 | Krist et al. | 30/425 X |
| 3,085,327 | 4/1963 | Douis et al. | 214/305 X |
| 3,171,449 | 3/1965 | Ellms et al. | 414/412 X |

*Primary Examiner*—Robert G. Sheridan

*Attorney, Agent, or Firm*—Stevens, Davis, Miller & Mosher

[57] ABSTRACT

In a method and apparatus for opening barrels containing granular or powdered products and the like and for emptying said barrels of their content without polluting the environment; wherein the barrel is placed with the peripheral portions of one of its end walls in a fixed sealing contact with a supporting surface provided with a through-feed opening for dumping content of the barrel and that the said end wall is cut through by relative rotation of the supporting surface and a knife means acting from beneath via said through-feed opening along a circular, arcuate line subtending at most 360° and causing the goods passing out through the broken end wall to fall down to a collecting point through a chute shielded from the surroundings.

22 Claims, 6 Drawing Figures

METHOD AND APPARATUS FOR OPENING BARRELS AND FOR EMPTYING SAID BARRELS OF THEIR CONTENTS WITHOUT POLLUTING THE ENVIRONMENT

The present invention relates to a method for opening barrels containing liquids, granular and powdered products and the like, and for emptying said barrels of their contents without polluting the environment.

The increased knowledge which has been obtained with respect to the potential risks which chemicals and like harmful substances present in the surrounding atmosphere represent to the human system, has caused the requirements placed on the care and protection of the environment to be progressively sharpened.

In this respect it is natural to direct particular notice to those processes or working operations in which chemicals, products in powder form or products which are correspondingly harmful are handled, in order to avoid the spreading of such chemicals and products from source.

The transfer of chemicals from their transport containers to a form suitable for further processing/use, normally represents a serious problem to the consumer.

A conventional way of handling chemicals or the like for shipment or other transport is to pack the same in so-called transport barrels or casks, normally such of round cross-section, which subsequent to being filled are closed and sealed by means of a separate lid or end wall. When opening such a barrel or cask, this lid is normally broken open or removed with said barrel in an upstanding position.

A preferred method of opening such a barrel is one in which the lid is prized around the circumference thereof with a pneumatic chisel (spikes). This method is not favourable to the working environment, however, since it is physically demanding, noisy and creates dust when the barrel contains dry goods.

Subsequent to opening the lid of the barrel, the contents thereof are normally emptied therefrom freely into collecting vessels, distribution channels or the like, by tipping up the barrel. The emptying of such a barrel in this way normally results in the creation of large amounts of dust, which subsequently spreads into the surrounding atmosphere, whilst the procedure of emptying the barrel is physically demanding.

Attempts have been made to alleviate the physical work involved in emptying such a barrel, by using such mechanical aids as barrel-turning devices, which may be mechanical or of another type, but these devices are normally relatively complicated, space consuming and expensive.

Attempts have also been made to reduce such spreading of dust by encapsulating the emptying site, in combination with gas cleaning and the removal of the dust by suction. Such encapsulation, however, requires complicated emptying apparatus and, as a result of the fact that emptying is normally instantaneous, places high requirements on the capacity and cleansing ability of the ventilating apparatus, and consequently this method has only been used and applied in practice on special occasions.

Consequently, the object of the invention is to solve the aforementioned problems encountered when opening and emptying such transport barrels in a simple and efficient manner, and, at the same time, to prevent effectively the spreading of dust without necessitating the use of expensive and space-consuming, auxiliary ventilating equipment.

Accordingly, the method according to the invention is characterized by placing the barrel in a manner such that the peripheral portions of one end wall thereof rests against a sealing surface having a through-feed opening, through which goods can be emptied; and by fixing the barrel in the desired position relative to said through-feed opening, whereafter during rotation of the sealing surface and the knife means about an axis from beneath, via said through-flow opening, the end wall is cut through by means of a knife means along a circular, arcuate line subtending at most 360°; and by causing the goods passing from said barrel as a result of cutting said end wall to fall down through said feed-through opening to a collecting station through a chute, passage, or the like shielded from the surroundings.

The invention also relates to an apparatus for carrying out the method, said apparatus being characterized in that it comprises a support means provided with a through-feed opening for receiving goods emptied from the barrel, said support means being adapted to support on a sealing surface surrounding said through-feed opening an unopened transport barrel placed on said support means in a manner such that the peripheral portions of one end-wall of said barrel sealingly abut said sealing surface, said support means having associated therewith securing means for fixing the barrel in the desired position relative to said through-feed opening; knife means extending from the under side of said support means through said opening into cutting engagement with said end-wall of said barrel, said support means and said knife means being rotatable relative to one another about an axis of rotation; and a fall-chute, channel or the like arranged in conjunction with the support means and shielded from the surroundings, for conducting goods falling from the barrel via said through-feed opening to a collecting station for said goods.

The invention will now be described in more detail with reference to a number of embodiments thereof illustrated schematically in the accompanying drawings, further characterizing features of the invention being disclosed in conjunction therewith.

In the drawing

Figure 1:
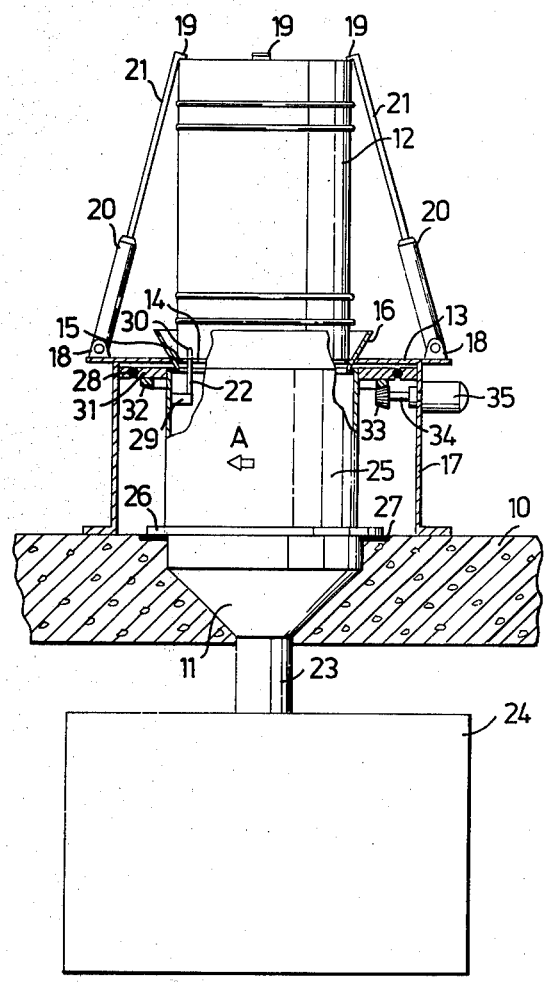
FIG. 1 is a front view, partially in section, of an embodiment of a barrel opener according to the invention.

Referring first to the embodiment of a barrel opener according to the invention illustrated in FIG. 1, there is shown a floor 10 having a downwardly conical goods-receiving funnel 11 extending therethrough, said goods being normally powdered products intended to be emptied from a transport container, e.g. the transport barrel shown at 12 in the Figure, placed in the barrel opener without polluting the environment or creating dust therein, subsequent to penetrating the bottom end-wall of said container. In the illustrated embodiment, the device in which the barrel 12 is placed for emptying comprises, in principle, a support plate 13 or the like having arranged therein a circular through-feed opening 14 for permitting exit of the goods from the barrel 12, the diameter of said opening being smaller than that of said barrel 12. The device is so constructed that the edge 15 around the through-feed opening 14 can be used as a support surface for the peripheral portions of the bottom wall of the barrel 12, said bottom wall normally being defined by a circumferentially extending end-flange or bead, said flange forming in practice the only surface by which the barrel rests on the support surface 15. Extending upwardly from the support plate 13 is a centrering cone 16 which is centred with respect to the centre axis of the through-feed opening 14 and the inner wall of which, when the barrel is placed on said device, is intended to centre said barrel in relation to said through-feed opening whilst using the lower end flange of said barrel to this end.

The support plate 13 rests on the floor 10 for the barrel opener via a closed frame structure, shield or the like 17. Pivotally mounted on the support plate 13 in bearing blocks 18 are three securing means, generally identified at 21, which are intended to positively hold the barrel 12 locked against the edge 15 of the support plate 13 during an emptying procedure with a good seal between said edge and said barrel.

The securing means 21 may be of any suitable type, e.g. purely mechanical or, alternatively, of pneumatic or hydraulic type. For the sake of simplicity it is assumed in the illustrated embodiment that the securing means 21 operate in conjunction with piston-cylinder devices 20 of known type with pistons operating therein, the piston rods of which pistons are provided at their free ends with the illustrated gripping means 19 for gripping over the upper edge of the barrel. The means for moving the pistons and piston rods may, as desired, be a pneumatic or hydraulic pressure medium of suitable type. By loading one side of an inner piston (not shown) in the piston cylinders 20 it is possible to cause the piston rods, in the one instance, to rapidly grip the barrel to fix the same in the operating position, and, in the second instance, to cause the piston rods to rapidly release the barrel thereby enabling it to be comfortably lifted away after emptying the same and to replace it with a new, unopened barrel.

One of the more essential prerequisites for carrying out the method according to the invention is that it shall be possible, for the purpose of cutting the end wall forming the bottom of the barrel 12, to rotate the barrel and a knife means for cutting said end wall relative to one another. In a simple case, such as that illustrated in the embodiment of FIG. 1, the barrel is held against rotation and the knife means rotated relative thereto along an arcuate line, whilst cutting through the bottom of the barrel.

In accordance herewith, there is arranged in the embodiment of FIG. 1 a knife means 22 which is rotatably arranged with its cutting edge working on a radius around a rotary axis substantially in the plane of the lower end wall of the barrel. The manner in which this is effected and the means required in principle therefor will be described in more detail hereinafter.

With regard to the aforedescribed through-flow opening 14 through which the goods are emptied from the barrel 12, said goods are caused, in conjunction with cutting the end wall, to fall down into the receiving funnel 11 and to be transported therefrom, via a pipe 23, downwardly into the container 24, which may be, for example, a stationarily located storage or a transport container.

In order to prevent the goods emptied from the barrel 12 from spreading to the surroundings during the passage of said goods from said barrel to the receiving funnel 11, via the through-opening 14, there extends between said opening 14 and said funnel 11 a tubular shield 25, which, as shown by the arrow A, is arranged for rotation clockwise about its centre axis. The lower end of the tubular shield 25 rests against the floor 10 via a circular flange 26 and an intermediate seal 27, and is supported at the top thereof for rotation about its centre axis in the frame 17 via a bearing generally identified by the reference 28, said bearing being a slide bearing, a roller bearing or a ball bearing.

The knife means 22 is stationarily mounted to the inner surface of the tubular shield 25 by means of a bracket 29 and is illustrated in the Figure with its cutting edge 30 penetrating the bottom or end wall of the barrel 12 in a starting position for rotation in and for cutting through said bottom or end wall along an arcuate line around said rotary axis. It will be noted in this respect that, as a result of this simple structural measure, it is possible when placing the barrel on the support plate 13 to do so with such force that the edge 30 of the knife means 22 has penetrated the lower end wall and reached a position of cutting engagement before the barrel has been clamped firmly by means of the securing means 21 and rotation has commenced.

Since the tubular shield 25 is rotatably mounted through the bearings 28, the knife means 22 is also rotatably mounted about the rotary axis of the shield 25 and is thus able to cut the bottom wall of the barrel along an arcuate line around the centre axis of the tubular shield. Although it is possible in accordance with the invention to cut the end wall through a maximum of 360°, it is also possible in accordance with the invention to interrupt the cutting procedure at a suitable angle before 360° is reached; the advantage afforded hereby is that the severed portion of the bottom wall of the barrel is held joined to said barrel by the remaining, uncut portion of the end wall, this uncut portion being later used as a hinge means when the weight of the goods in the barrel is sufficient to swing the cut portion of the bottom wall downwardly. If the end wall is cut through 360° the bottom of the barrel will accompany the goods along its fall path and must be removed from said path, such removal being difficult to effect, consuming time and being liable to pollute the surroundings by dust. These problems are obviated when the bottom wall is cut through less than 360°.

Rotation of the tubular shield 25 can, in accordance with the invention, be effected in the simplest case manually by means of, for example, a crank and a simple reduction gear of known type.

In view of the fact, however, that the force required to carry out the cutting process is relatively high it is desirable that rotation is effected mechanically, as illustrated in FIG. 1. To this end, there is mounted on the under side of the inner bearing ring 31 a circular gear ring 32 which is arranged to co-act with a smaller drive wheel 33 to drive said gear ring 32. This drive wheel 33 is mounted on an output shaft 34, for example the output shaft of an electric motor 35 stationarily arranged on the frame 17 and drives the tubular shield 25, and therewith the knife means 22, via the drive wheel 33 and the gear ring 32. The motor 35 can be arranged to drive the tubular shield 25 either continuously or intermittently.

By means of the aforedescribed barrel opener, it is possible in a comfortable manner to open and empty a storage barrel without dirtying the surroundings or creating dust therein. The barrel opener also solves the hitherto prevailing problems of risking the health of workmen involved with the emptying of said barrel in an expedient and efficient manner.

Figure 2:
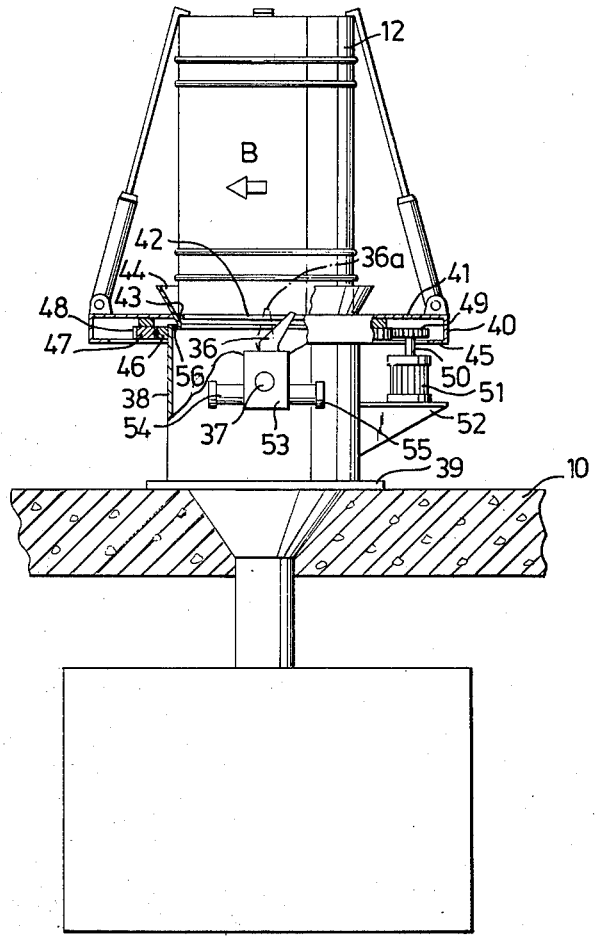
FIG. 2 is a modified embodiment of the barrel opener according to FIG. 1.

Different variations or modifications of the barrel opener according to FIG. 1 lie within the scope of the invention. As an example of such a variant there is illustrated in FIG. 2 a further barrel opener constructed according to the invention, which barrel opener, as opposed to the embodiment illustrated in FIG. 1, is arranged to rotate the barrel 12 clockwise around its centre axis in the direction of the arrow B, the knife means 36 for cutting the bottom end wall of the barrel being, in this case, mounted on a stationary shaft 37 for carrying out a pivoting, reciprocating movement. In the illustrated embodiment of FIG. 2 the rotatably mounted, tubular shield 25 of the FIG. 1 embodiment is replaced by a non-rotatably mounted, tubular shield 38 which sealingly rests against the floor 10 via a lower flange 39.

Further, the stationary and non-rotatable support plate 13 of the FIG. 1 embodiment is replaced in the FIG. 2 embodiment by a rotatable gear housing 40. The upper defining plate 41 of the gear housing 40 exhibits centrally thereof a circular through-flow opening 42 through which goods emptied from the barrel 12 can pass, the barrel, similar to the case in the embodiment shown in FIG. 1, resting on the peripheral edge 43 defining the through-flow opening 42. As with the case of the FIG. 1 embodiment, there projects upwardly from said edge 43 defining said opening 42 a conical funnel 44 which is centred with respect to the axis of the through-flow opening 42 and the walls of which are intended to centre the barrel 12 on said peripheral edge 43. It will also be seen from the Figure that the lower part of the gear housing 40 is defined by an inwardly extending circular flange 45.

The gear housing 40 is rotatably mounted about the upper portion of the non-rotatable, tubular shield 38 by means of a radial bearing, the inner bearing ring 46 of which is fixed to the cover 38 and the outer bearing ring 47 of which is fixed in a convenient manner to the under side of the support and defining plate 41 of the gear housing.

As will be seen from FIG. 2, the outer bearing ring 47 is provided with a peripheral gear ring 48 arranged to be driven by a gear wheel 49 meshing therewith. The gear wheel 49 is fixedly mounted on the output shaft 50 of a drive device, for example an electric drive motor 51. This rests on a stationary bracket 52 mounted on the outside of the non-rotatable, tubular shield 38. In accordance with the aforegoing, the gear housing 40 is solely defined on its under side by the inwardly extending ring flange 45, the internal radius of which is sufficiently large to ensure that the gear housing is not obstructed by the stationarily arranged motor shaft 50 upon rotation of said gear housing in the direction of the arrow B.

Returning to the aforeindicated knife shaft 37, it will be observed that this shaft is journalled in a separate drive means 53 constructed in a manner such as to cause the knife means 36 to pivot forwards and backwards. This drive unit 53 is stationary mounted on the outside of the non-rotatable, tubular shield 38, the shaft 37 extending radially through and into the shield 38 via suitable seals, where said shaft 37 supports the knife means 36 in a manner such that it is able to pivot on a desired radius relative to the centre axis of the through-feed opening 42 and to extend through said opening into cutting engagement with the bottom of the barrel 12, and such that it can also be swung out of engagement with said bottom. The arrangement is also such that with the aid of the drive unit 53 it is possible to cause the knife means 36 to carry out a continuous, pivoting movement during the whole of the cutting operation. This is indicated in the Figure, in which the knife means 36 is shown in its position of cutting engagement with the bottom end wall of the barrel in dash-lines **36*a***, and in its position in which it is moved out of cutting engagement with said bottom end wall in full lines.

The drive unit can, in accordance with the invention, comprise any known suitable mechanism by which the knife shaft 37 can be swung forwards and backwards, or alternatively, by which the knive means can be moved forwards and backwards in a translatory movement. For example, there can be used a reciprocatingly drivable rack which, via a gear (not shown) on the knife shaft, is able to actuate said drive shaft to carry out its pivoting movement. In the illustrated embodiment, there extend outwardly from the actual drive unit 53 two closed housings or cylinders 54 and 55 adapted to alternately receive a reciprocatingly moving drive means for the knife shaft 37, e.g. said rack. The cylinders may alternatively form pressure cylinders for pistons of known type operated by pressure media for actuating the knife shaft in a manner such that said shaft carries out said reciprocating movement. The choice of drive unit depends upon the prevailing circumstances and does not constitute any part of this invention.

In order to prevent goods emptied from the barrel from entering the surroundings through the gap between the funnel 44 and the non-rotatable shield 38 there is arranged in said gap, in accordance with the invention, a sealing ring 56 which permits sliding of the funnel thereupon whilst sealing against the inner surface of the non-rotatable shield 38.

Figure 3:
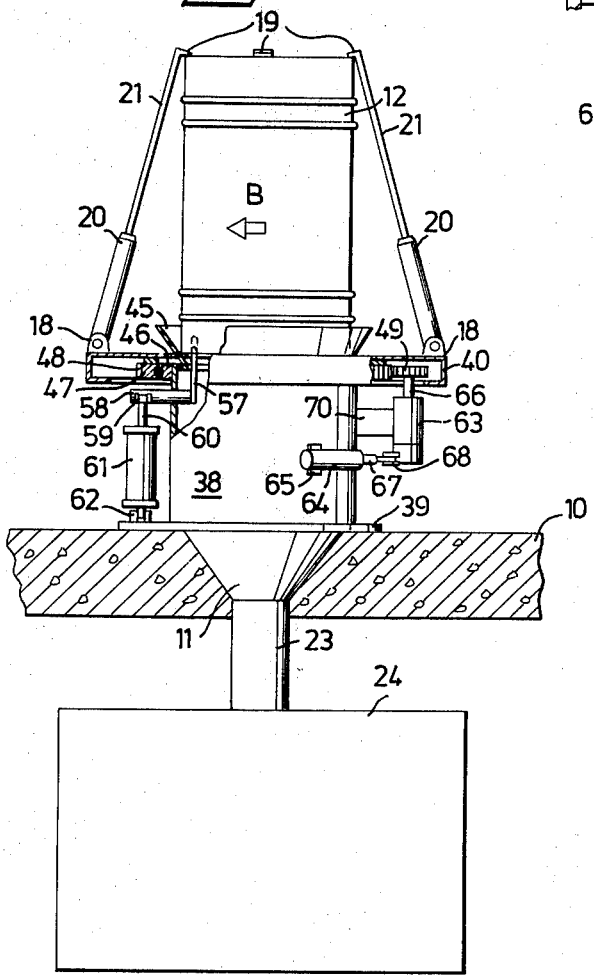
FIG. 3 is another variant of a barrel opener according to the invention, said variant substantially comprising a combination of the barrel openers shown in FIGS. 1 and 2.

In FIG. 3 there is illustrated a further embodiment of a barrel opener according to the invention, this embodiment being a modification in detail of the embodiment illustrated in FIG. 2. Elements which are common to the embodiment shown in FIGS. 1, 2, 3, 4, 5 and 6 have been identified by the same reference numerals in all Figures The barrel opener illustrated in FIG. 3 is a development of the invention in which a knife means 57 is arranged to carry out a translatory or pivoting movement backwards and forwards during a cutting operation, the gear housing with the barrel 12 resting thereupon being arranged to be rotated intermittently, in steps in the direction of the arrow B.

To this end the knife means 57 of the FIG. 3 embodiment is fixedly mounted on a shaft 58 which is pivotally journalled in the wall of the tubular shield 38 and projects thereinto with its knife-holding end. The outer end of the shaft is provided with a lever extending at right angles to the shaft, the free end of which lever is provided with a bearing stirrup 59. Pivotally mounted in the bearing stirrup 59 is the piston rod 60 of a doubleacting pressure piston-cylinder device 61, the actual pressure piston-cylinder device being pivotally mounted in a bearing stirrup 62 which, in turn, is fixedly mounted on the base flange 39 of the shield 38. By applying pressure medium alternately to each of the pressure surfaces of the working piston of the piston-cylinder device, the piston rod 60 is caused to swing the knife means 57, via said lever and said shaft 58, through a given angle backwards and forwards whilst cutting the end wall of the barrel 12.

On the other hand, the gear housing 40 of the described embodiment is rotated, via the gear wheel 49 and the gear ring 48, intermittently, clockwise in the direction of the arrow B over an idling device, generally identified by the reference 63, of a hydraulic or pneumatic pressure medium motor 64 which is pivotally mounted at one end thereof on a bearing stirrup 65 fixedly mounted on the shield 38, and whose piston rod 67 is pivotally connected with a rotatable part of the idling device 63 via a bearing stirrup 68.

Figure 4:
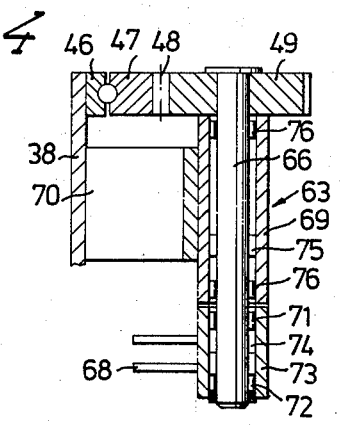
FIG. 4 is a detailed view in section of a drive means having a free-wheel hub and forming part of the embodiment of the barrel opener shown in FIG. 3.

The aforementioned idling means 63 and force-transmission elements associated therewith are illustrated in larger scale in FIG. 4. This Figure illustrates a section of the tubular shield 38, on the outside of which the inner ball-bearing ring 46 is mounted; the outer ball-bearing ring 47 with its associated gear ring 48; the driving gear wheel 49; and the shaft 66 on which said wheel 49 is mounted. The shaft 66 is rotatably mounted in two bearings 76 which are, in turn, mounted in a bearing sleeve or the like 69 stationarily mounted on the tubular shield 38 via the bracket 70. The lower end of the shaft 66 is pivotally mounted in a separate sleeve-like element 73 by means of bearings 71 and 72, said element 73 supporting said bearing stirrup 68 in FIG. 3 for the piston rod. Inserted between the shaft 66 and the sleeve-like element 73 is a drive means 74 of known type operative to drive in one direction of rotation, i.e. counter clockwise in FIGS. 3 and 4, and idling in the opposite direction of rotation. With particular reference to FIG. 4, this means that if the sleeve element 73 is rotated counter clockwise, the shaft 66 and the gear wheel 49 are dogged in the same direction of movement by the drive element 74, whereupon the gear ring 48, and therewith the gear housing 40 and elements mounted thereon, together with the barrel 12 are rotated clockwise in the direction of the arrow B in FIG. 3 through a rotation step whose magnitude is dependent upon the length of the stroke carried out the piston rod 67.

When the piston rod 67 completes its working stroke and has been withdrawn to its starting position in the cylinder 4, the drive element 74, and therewith the sleeve element 73, free wheel in relation to the shaft 66.

In order to latch the shaft 66 against unintentional rotation of the gear wheel 49 rearwardly, clockwise, each time said gear wheel has determinated a forward step with respect to the gear ring 48, there is arranged between the shaft 66 and the bearing sleeve 69 an element 75 of a similar type to the element 74 in the sleeve-like element 73, said element 75 preventing rotation of the shaft 66 in a counter clockwise direction during that period when the sleeve element 73 is again rotated to the starting position in a clockwise direction but which, on the other hand, permits an idling movement of the shaft 66 in the bearing sleeve 69 when said shaft during working movement of the sleeve element 73 counter clockwise rotate the gear wheel 49 one feed step.

If the index feed of the gear ring 48 is coordinated in some suitable manner with the pivot movement of the knife means 57, it is possible to obtain favourable cutting of the bottom wall of the barrel 12.

In accordance with a suitable pattern of coordination of the index feed of the gear ring 48 with the pivot movement of the knife means 57, the barrel opener is started, whereupon the knife means 57 is tilted upwards to cut into the end wall of the barrel 12 in the neighbourhood of its periphery. The knife means 57 is then tilted back downwardly to an intermediate position which is short of its original starting position, in which intermediate position said knife edge is still located radially within the end wall. In this position the gear housing 40 is rotated one feed step via the gear wheel 49 and the gear ring 48, which causes the barrel 12 to be rotated to a corresponding extent in the direction of rotation. The knife means 57 is then tilted again to its upper limit position, in which it again cuts the end wall of the barrel through a given distance, to again be tilted back to said intermediate position for renewed rotation of the barrel, etc. In the illustrated embodiment, the clipping or cutting movement of the knife means 57 together with rotation of the barrel 12 is considered to be effected fully automatically in coordination.

Rotation of the barrel 12 and tilting of the knife means 57 can be effected through an arcuate line in the neighbourhood of an optionally more than 360°, whereupon a circular plate is cut from the end wall of the barrel 12, this circular plate accompanying the goods emptied from said barrel.

Alternatively, rotation of the barrel and cutting of the end wall thereof may be terminated prior to reaching 360°, in a manner such that the bottom plate of the barrel is still joined thereto.

It has been assumed in the embodiments described with reference to FIGS. 1–4 that the relative rotation of respective knife means 22, 36 and 57 to the barrel 12 shall be carried out by means of suitable motors, the operation of which is controlled by means of suitable, manually actuable controls of known type.

In these embodiments, the bottom wall of the barrel 12 is cut along an arcuate line subtending 360° whilst manually monitoring and operating the controls, thereby to free a circular plate from the bottom wall of said barrel. This circular plate is then permitted to fall down in the path followed by the goods being emptied with the intention of removing said plate thereafter.

In many cases, however, this circular plate represents a serious obstacle to the goods and when it is necessary to have access to the path travelled by said goods from without in order to remove said freed, circular plate, the goods may, on occasion, penetrate into the surroundings, to unintentionally pollute the same.

Alternatively it is possible in practice, whilst monitoring the operation of the drive motors manually, to interrupt a cutting operation at any angular position before 360° is reached, whereby the cut part of the bottom of the barrel remains joined thereto and does not accompany the goods emptying from said barrel. Subsequent to emptying the barrel, the barrel can be removed in its entirety, i.e. together with the partly cut-away bottom part of the barrel, this partially-cut-away part no longer presenting any problem.

In accordance with the invention, different embodiments of barrel openers of the aforementioned type can be operated in the manner described by solely manually regulated controls. This is fully satisfactory when only a single barrel or small groups of barrels is or are to be opened and emptied on remote occasions.

When on the other hand, for example, on large scale operations, much larger quantities of goods are required to maintain a continuously operating working process, it is often necessary, or at least desirable to be able to cut the bottom wall of substantially continuously advancing barrels by automatic control means. This does not prevent, however, the barrel openers from being arranged for both manual and automatic control of the cutting process. This can be the case in respect of all three of the barrel openers described with reference to FIGS. 1–3.

The simplest embodiment of a barrel opener according to the invention and illustrated in FIG. 1 has been selected to illustrate this alternative of automatic control. This embodiment has been made the subject of FIGS. 5 and 6, identical elements in the Figures being identified by the same reference numerals as those used in FIG. 1.

Figure 5:
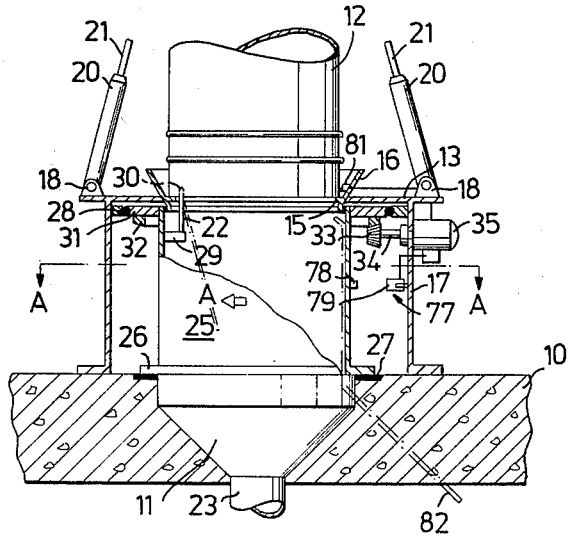
FIG. 5 shows the embodiment according to FIG. 1 but also illustrates schematically monitoring means for monitoring the operation of the barrel opener.
Figure 6:
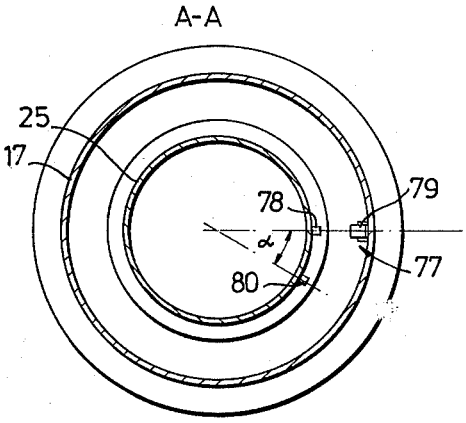
FIG. 6 is a cross-sectional view of FIG. 5 illustrating more clearly the location and function of the monitoring means.

In FIGS. 5 and 6 there is shown by way of example an automatically operating device for delimiting the arcuate line along which the knife means 22 shall cut the bottom wall of the barrel 12, an automatically operating device generally designated by 77 mounted in the barrel opener for the driving motor 35 of said opener.

This operating device comprises substantially two separate elements 78 and 79, of which one, 77, is fixedly mounted on the outside of the tubular shield 25 and the other, 79, is fixedly mounted on the inside of the screen or the frame 17. The type of operating device selected is not important to the invention itself, since the most important function of said device is that it shall be capable of automatically stopping the motor when the knife means 22 has cut through the bottom wall of the barrel along an arcuate line subtending a preselected number of degrees.

With respect to the different operating devices which can be envisaged, the element 78 in accordance with one alternative may, for example, comprise a circuit breaker arranged to mechanically actuate the element 79, which in such case may comprise a switch, normally a micro-switch, adapted to control the controls of the motor.

In accordance with another alternative, the element 78 and 79 may be incorporated in a photo-electrical monitoring device of known type, combined with a suitable light source.

In accordance with another alternative, the element 78 and 79 may be incorporated in an electronic signal producer of known type which operates in accordance with the inductive sensing principle, i.e. contact free.

The position which the element 79 is shown to occupy in FIG. 6 represents a fixed limit position.

The following, brief comments are made with reference to the function of the operating device in conjunction with a barrel-opening process. When the element 78 is located opposite the limit position 79, an unopened barrel is placed in the barrel opener, whereafter rotation of the shield 25 is begun by manually operating a control (not shown) of the motor 35.

On the outside of the tubular shield 25, however, there is placed at a given angular displacement $\alpha$ from the position of the element 78 a further element 80 which is of the same construction as said element 78.

Rotation of the tubular shield 25, and therewith commencement of the cutting operation of the knife means 22, continues subsequent to the aforementioned start until the element 80 has reached a position opposite the limit position 79, at which point the rotary movement of the shield 25 and therewith the knife means 22 is automatically stopped by an operating signal sent by the element 79 to the motor control means.

When this stage has been reached, the barrel has been emptied of its contents and moved from the barrel opener, whereafter a further, unopened barrel is placed in the position of the previous barrel.

The shield 25 and the knife means 22 are again manually caused to rotate in the aforedescribed manner. Optionally, this manual start can be caused to take place, to some extent, indirectly, by causing said barrel each time a fresh barrel is placed in the barrel opener to actuate a barrel-sensing switch 81 arranged in the support means, said switch being coupled to the motor control means thereby to automatically activate the motor and to deactivate the same subsequent to removing the barrel after emptying the same.

The magnitude of the angle $\alpha$ between the two elements 78 and 80 on the shield 25 is predetermined to ensure that the uncut, angular section of the barrel bottom corresponding to said angle $\alpha$ is sufficiently flexible to serve as a hinge for the cut, angular section of said barrel bottom, thereby enabling the said cut portion of said barrel bottom to be automatically swung away under the load of the goods in the barrel in the manner of a flap, thereby opening the barrel to enable the goods to be emptied therefrom.

For the purpose of effectively removing any goods which may remain in the barrel subsequent to emptying the same, the barrel opener is conveniently provided with an internal flushing device 82 operating with air or liquid.

The invention is not restricted to the described and illustrated embodiments thereof, but can be modified within the scope of the following claims.

I claim:

1. A method for opening barrels containing liquid, granular, or powdered products and the like and for emptying said barrels of their content without polluting the environment, characterized by placing the barrel in a manner suc that the peripheral portion of one end wall thereof rests against a sealing surface having a through-feed opening through which goods can be emptied; fixing the barrel in the desired position relative to said through-feed opening, producing a relative rotation between the sealing surface and a cutting means located beneath the one end wall of the barrel; cutting through the end wall during the relative rotation of the sealing surface and the cutting means about an axis of rotation along a circular, arcuate line subtending at most 360°; causing the goods to pass from said barrel as a result of cutting said end wall to descend through said feed-through opening to a collecting station through a chute, passage, or the like shielded from the surroundings.

2. A method according to claim 1, characterized by cutting the end wall along an arcuate line which subtends an angle whch is less than 360° by an amount to ensure that the uncut portion up to said angle 360° is able to retain the cut portion of said end wall joined to said barrel and, in addition thereto, to form a hinge by which the said cut portion of said end wall can bend or spring down under the load of the goods in the barrel upon termination of the cutting process.

3. A method according to claim 1 or 2, characterized in that subsequent to being emptied the barrel is flushed clean from the chute side by means of a gaseous or liquid medium.

4. A method according to claim 1 or 2, characterized in that the relative rotation comprises rotating the sealing surface with the barrel resting thereupon relative to the cutting means arranged stationarily at a preselected radius from said axis of rotation.

5. A method according to claim 1 or 2, characterized in that the cutting means is rotated at a preselected radius around the rotation axis and maintaining the sealing surface with the barrel resting thereupon in an unrotated position.

6. A method according to claim 4, characterized in that the relative rotation is a continuous rotary movement.

7. A method according to claim 4, characterized in that the relative rotation comprises a plurality of sequential intermittent step-like movements.

8. A method according to claim 2, characterized in that the cutting means is caused to move backwards and forwards in the cutting path during the cutting operation.

9. A method according to claim 2, characterized in that the relative rotation is effected by means of a driving motor provided with motor control means; and in that, subsequent to starting the motor, the relative rotation, and therewith the cutting of said end wall of the barrel, is permitted to continue along an arcuate line up to a predetermined limit position, corresponding to an arc subtending less than 360°, whereafter when this limit has been reached the motor control means are actuated to stop the operation by means of a sensing signal sent from an automatically operating control device.

10. A method according to claim 9, characterized in that start of the driving motor is controlled in response to the location of a barrel in the opening and emptying position, by means of a barrel-sensing switch, and wherein a sensing signal sent by said barrel-sensing switch to said motor control means is used to start said drive motor.

11. An apparatus for opening barrels containing liquid, granular or powdered products and the like, and for emptying said barrels of their content without polluting the environment, characterized in that it comprises a support means provided with a through-feed opening for receiving goods emptied from the barrel, said support means being adapted to support on a sealing surface surrounding said through-feed opening an unopened transport barrel placed on said support means in a manner such that the peripheral portions of one end-wall of said barrel sealingly abuts said sealing surface, said support means having associated therewith securing means for fixing the barrel in the desired position relatively to said through-feed opening; knife means extending from the under side of said support means through said opening into cutting engagement with said end-wall of said barrel, said support means and said knife means being rotatable relative to one another about an axis of rotation; and a fall-chute, channel or the like arranged in conjunction with the support means and shielded from the surroundings, for conducting goods falling from the barrel via said through-feed opening to a collecting station for said goods.

12. An apparatus according to claim 11, characterized in that the support means is mounted for rotation about said axis of rotation; and in that the knife means is stationarily arranged at a given radius from said axis of rotation.

13. An apparatus according to claim 11, characterized in that the knife means is pivotally mounted on a given radius around said axis of rotation; and in that the support means is non-rotatably arranged.

14. An apparatus according to claim 12, characterized in that respective rotatable elements are arranged to co-act with a drive motor which is arranged to effect said rotation in the form of a continuous movement.

15. An apparatus according to claim 12 or 13, characterized in that respective rotatable elements are arranged to co-act with a drive motor, which is arranged to effect said rotation in the form of sequential, intermittent steplike movements.

16. An apparatus according to claim 13 characterized in that the respective rotatable elements are arranged to coact with the drive motor which is arranged to affect said rotation in the form of a continuous movement.

17. An apparatus according to claim 14 or 16, characterized in that the knife means is mounted to carry out a reciprocating movement in the cutting path during the cutting process.

18. An apparatus according to any one of claims 14 or 16, characterized in that the drive motor is provided with a manually actuable motor control means, said means being also arranged to co-act with an automatically functioning operating-device which is arranged to activate the motor control means in a manner such as to stop the operation of said motor when a given limit position for the cutting operation is reached, said limit position corresponding to less than 360° of said relative rotation.

19. An apparatus according to claim 11, characterized in that the support means is provided with a barrel-sensing switch which is coupled to the motor control means in a manner such as to activate and deactivate said motor control means in response to the presence or absence of a barrel on the support means.

20. A method according to claim 5 characterized in that the relative rotation is a continuous rotary movement.

21. A method according to claim 5 characterized in that the relative rotation comprises a plurality of sequential intermittent step-like movements.

22. An apparatus for removing the contents of a barrel, comprising:

a chute for receiving the contents of said barrel;

means for vertically supporting a barrel on one end over said chute;

means for sealing said one end with said chute whereby the contents of said barrel are maintained within said chute when opened;

cutting means located at said one end for cutting said one end along its periphery;

means for providing relative rotation between said cutting means and said barrel along the axis of said barrel whereby said one end is cut along its periphery during said relative rotation until the contents of said barrel force the cut portion of said one end to be deflected into said chute whereby said contents are released within said chute.

* * * * *